United States Patent [19]

Taniguchi

[11] Patent Number: 4,983,045

[45] Date of Patent: Jan. 8, 1991

[54] MIXER

[75] Inventor: Toru Taniguchi, Tokyo, Japan

[73] Assignee: Reica Corporation, Tokyo, Japan

[21] Appl. No.: 264,434

[22] Filed: Oct. 28, 1988

Related U.S. Application Data

[63] Continuation-in-part of Ser. No. 931,679, Nov. 17, 1986, abandoned.

[30] Foreign Application Priority Data

| | | | |
|---|---|---|---|
| Nov. 22, 1985 | [JP] | Japan | 60-264152 |
| May 1, 1986 | [JP] | Japan | 61-102393 |
| May 28, 1986 | [JP] | Japan | 61-81578 |
| Aug. 12, 1986 | [JP] | Japan | 61-190009 |
| Aug. 3, 1988 | [JP] | Japan | 63-195151 |

[51] Int. Cl.[5] ..... B01F 11/00

[52] U.S. Cl. ..... 366/117; 366/256; 366/258

[58] Field of Search ..... 366/116, 117, 118, 255, 366/276, 64, 96, 108, 110, 114, 600, 322, 324, 256, 258, 128

[56] References Cited

U.S. PATENT DOCUMENTS

| | | | |
|---|---|---|---|
| 3,570,654 | 3/1971 | Hill | 366/322 X |
| 4,187,030 | 2/1980 | Godley | 366/324 X |
| 4,199,956 | 4/1980 | Lunde | 366/241 X |
| 4,259,021 | 3/1981 | Goudy, Jr. | 366/118 |
| 4,302,112 | 11/1981 | Steenstrup | 366/127 X |
| 4,304,054 | 12/1981 | Nauck | 366/322 X |
| 4,406,548 | 9/1983 | Haws | 366/64 X |

FOREIGN PATENT DOCUMENTS

| | | | |
|---|---|---|---|
| 150822 | 8/1985 | Japan | 366/119 |
| 1105220 | 7/1984 | U.S.S.R. | 366/108 |

*Primary Examiner*—Robert W. Jenkins
*Attorney, Agent, or Firm*—Koda & Androlia

[57] ABSTRACT

The present invention provides a mixer having a duct into which a fluid (or fluids) is (or are) inducted and a stirrer disposed within the duct and adapted to stir and/or mix the fluid (or fluids) by repeating division and join on the fluid (or fluids) when the fluid (or fluids) moves (move) through the duct. The stirrer has a vane device dividing the interior of the duct into a plurality of spaces and openings formed in the vane device and through which the fluid (or fluids) moves (move) from one space to another. The mixer further includes a vibrator for vibrating the stirrer at a desired frequency. The vibrator may be of any one of various types vibrators such as an electromagnetically driven type vibrator consisting a coil and a permanent magnet, a motor drive type vibrator consisting of a motor-cam mechanism of a cam-follower mechanism and the like. The vibration of the duct or stirrer from the vibrator basically greatly increases the efficiency of the same stirring action as in the static type mixer and is also useful to eliminate any clogging on mixing powdery fluids. In addition, the vane may be in the form of a spiral screw-shaped vane which can exert a propelling force to the fluid (or fluids) in the desired direction during rotation of the stirrer.

4 Claims, 7 Drawing Sheets

MIXER

This is a continuation-in-part of application Ser. No. 931,679, filed Nov. 17, 1986 now abandoned.

BACKGROUND OF THE INVENTION

1. Field of the Invention

The present invention relates to a mixer comprising duct mean and stirring vane means located within the duct means and being effective to act on a flow of fluid passing through the duct means such that the flow of fluid will repeatedly be divided and joined together to provide a desired stirring action.

2. Description of the Prior Art

For various industrial fields, it is very important to uniformly stir and mix different types of materials which mainly include liquid and gas or powder. Particularly, chemical treating and/or food processing industries desire a mixer which can mix materials more efficiently and uniformly.

The general mixing is effected by driving stirring vanes within a mixing vessel through a motor or the like. It is also well-known in the art to use a static type mixer in which a mixing can be performed only by flowing fluids to be mixed therethrough without any external drive. Such a static type mixer comprises a duct for inducting fluids to be mixed and a number of stirring vanes statically disposed within the duct, whereby the fluids to be mixed can repeatedly be divided and joined together as they flow through the duct. Thus, the mixing action can more efficiently be realized even if the length of the duct is relatively short. For the above reasons, such a static type mixer is extensively utilized through various kinds of industrial fields.

Thus, the static type mixer is advantageous in that an actually sufficient mixing action can efficiently be accomplished without any external drive. However, various fields of foodstuffs, paints and fine chemicals require a further uniform and efficient mixing action. Therefore, the prior art static mixer may be insufficient to meet such severe requirements.

Particularly, when it is wanted to mix powders having fine particle size, the prior art static mixer tends to create clogging between the inner wall of the duct and the stirring vanes. If such clogging is released by any external pressure from either of the inlet or outlet of the duct, the mixer will perfectly be inoperative.

On the other hand, when stirring vanes are driven by a motor, an increased kinetic energy may be applied to the fluids to be mixed, so that their chemical properties will adversely be affected by the kinetic energy.

It is therefore desired to provide a new mixer which can overcome these problems in both the aforementioned systems.

SUMMARY OF THE INVENTION

To this end, the present invention provides a mixer comprising duct means for receiving a plurality of fluids, stirrer means disposed within said duct means and vibrator means for vibrating said stirrer within said duct means, said stirrer means including a stirrer shaft, stirring vane means rigidly mounted on said stirrer shaft to divide the interior of said duct means into a plurality of compartments or spaces and adapted to stir and mix said plurality of fluids inducted into said duct means and opening means formed in said stirring vane means to allow the passage of said fluids, whereby said fluids can be stirred and mixed together within said duct means as they move from one space to another through said opening means.

In such an arrangement, there can be made two types of stirring functions, that is, a stirring function in which the fluids are stirred by dividing and joining them through the opening means formed in the stirring vanes and another stirring function in which the fluids are finely and uniformly stirred by the vibrating surfaces of the stirring vanes driven by the vibrator. Thus, the fluids can be stirred very finely and uniformly under both the above-mentioned functions.

If the mixer according to the present invention is used to process foodstuffs, the finished food products will have a smooth feel. Furthermore, the mixer is very suitable for use in stirring polymeric materials in the field of fine chemicals.

For example, when it is wanted to whip raw cream, it is inducted into the duct means together with nitrogen. The duct or stirring means is then finely vibrated in the aforementioned manner to whip the raw cream very uniformly. Such a process can similarly be applied to the production of ice cream and other foodstuffs.

When it is desired to mix yogurt with a fruit, the latter will not be damaged on mixing.

The mixer constructed according to the present invention can further be applied to the process of mixing oxygen in a wine with nitrogen to prevent the wine from being oxidized without addition of any anti-oxidant.

The mixer of the present invention can further be applied to the treatment of paint or ink by mixing.

If the stirring vanes are of a crescent-shaped or of a spiral-shaped configuration having desired openings formed therethrough, the aforementioned stirring action can be more effective.

If the duct and stirrer have their axes extending vertically relative to the horizontal plane, the fluids can be more effectively stirred under the action of gravity.

Furthermore, the fluids can be moved more effectively in the desired direction if the stirrer shaft is rotatably driven.

DETAILED DESCRIPTION OF PREFERRED EMBODIMENTS

The present invention will now be described in more details by way of example with reference to the drawings.

Figure 1:
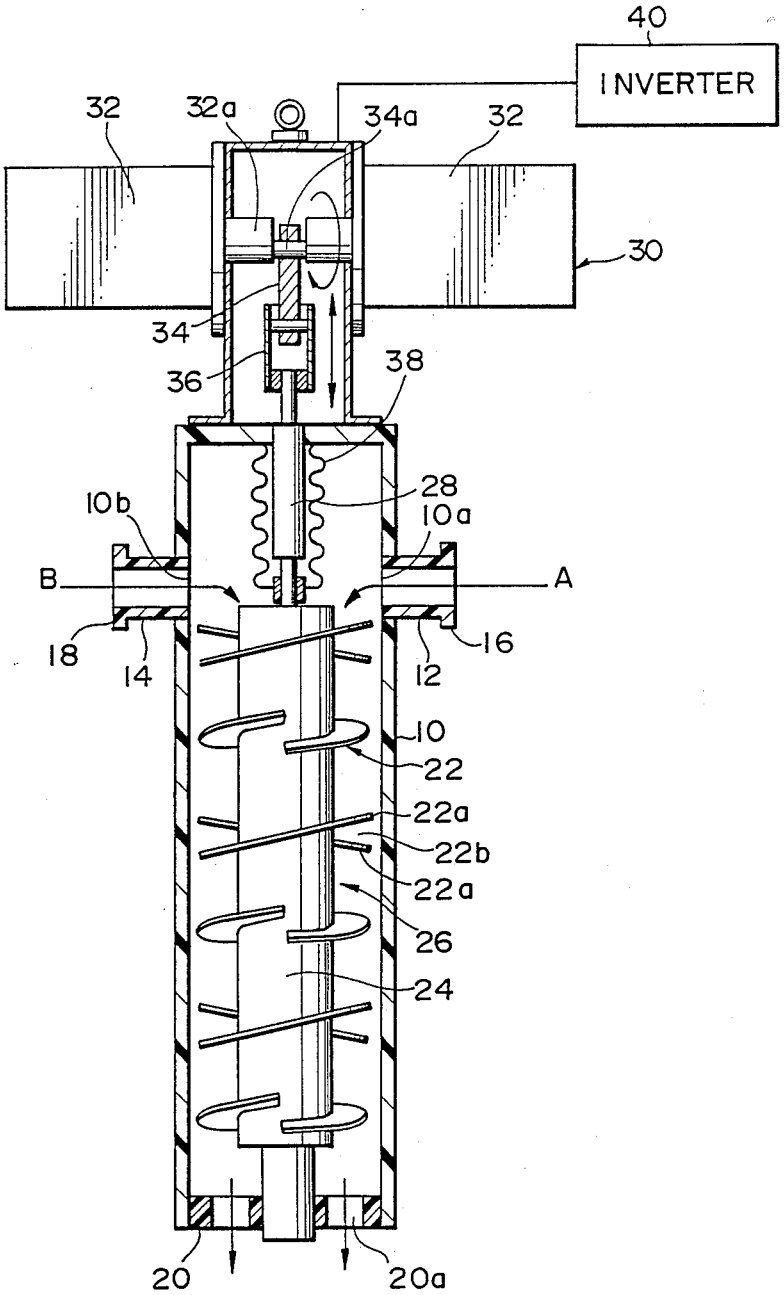
FIG. 1 is a schematic cross-section of the first preferred embodiment of a mixer constructed according to the present invention.

Referring first to FIG. 1, there is shown the first embodiment of a mixer constructed according to the present invention, which comprises a duct 10 formed of any material having a resistance for fluids to be mixed together, for example, plastics such as vinyl chloride or metal such as stainless steel. The duct 10 is of a hollow cylindrical configuration and has two inlet ports 10*a* and lO*b* which receive two different fluids to be mixed together, respectively. A branch pipe 12 or 14 is airtightly mounted about the corresponding inlet port 10*a* or 10*b*. The two different fluids shown by A and B in FIG. 1 are inducted into the duct 10 through the branch pipes 12 and 14, respectively.

Each of the branch pipes 12 and 14 has a flange 16 or 18 which is adapted to connect with the corresponding fluid passage (not shown). Each of the fluids to be mixed together will be moved into the duct 10 from the respective fluid passage under gravity or under the action of any suitable pumping system.

The duct 10 includes an end plate 20 which is rigidly mounted in the end of the duct 10 remote from the inlet ports 10*a* and 10*b* and having outlet ports 20*a* formed therein. The mixed fluids will be discharged into a downstream passage (not shown) from the end of the duct 10 through the outlet ports 20*a* of the end plate 20. The discharged fluid mixture may be subjected to a further treatment, if required.

The duct 10 further includes a stirrer 26 comprising a stirrer shaft 24 and a plurality of stirring vanes 22 rigidly mounted on the stirrer shaft 24 and spaced away from one another equidistantly along the longitudinal axis of the stirrer shaft 24. The stirrer 26 is supported so that it can be vibrated in the vertical direction.

The end of the stirrer shaft 24 is rigidly connected with a vibrating shaft 28 which in turn is operatively connected with an eccentric shaft 34*a* in a vibrator 30 through a joint 36 and a link shaft 34 pivotally connected at one end with the eccentric shaft 34*a*. The vibrator 30 further comprises a pair of motors 32. When the output shafts 32*a* of the motors 32 are rotated, the eccentric shaft 34*a* is eccentrically rotated to move the one end of the link shaft 34 along a circular path. Thus, the other end of the link shaft 34 reciprocates in the vertical direction to vibrate the vibrating shaft 28 in the same direction. As a result, the stirrer shaft 26 will be vibrated in the vertical direction as viewed in FIG. 1.

The vibrating shaft 28 is covered with a bellows 38 which serves to separate the vibrating shaft 28 and the opening in the top of the duct 10 through which the vibrating shaft 28 extends outwardly from the interior of the duct 10.

The end of the stirrer shaft 24 remote from inlet ports 10*a* and 10*b* is rotatably supported in an opening which is formed in the central portion of the end plate 20.

In the first embodiment, the motors 32 are energized through an invertor 40. Thus, the revolution of the motors 32 can be controlled by varying the frequency in the alternating current from the invertor 40 and then adjust the vibration of the stirrer 26, if desired. However, the vibrator 30 may be replaced by any other type of vibrator, for example, an electromagnetically driven vibrator.

In the first embodiment, each of the stirring vanes 22 in the stirrer 26 includes a pair of substantially crescent-shaped vane segments 22*a* which are rigidly secured to the stirrer shaft 24 at the diametrically opposed positions with the same angle relative to the axis of the stirrer shaft 24 but in the opposite directions. In such an arrangement, each of the stirring vanes will have openings 22*b* at its opposite ends.

After the fluids A and B to be mixed have been inducted into the duct 10 through the respective inlet ports 10*a* and 10*b*, they move within the duct 10 along the opposite faces of the stirring vanes through the openings 22*b*.

At the same time, the stirrer 26 is vertically vibrated by the vibrator 30. The fluids moving along the faces of the stirring vanes 22 are thus stirred very finely under the vibration in the stirring.vanes 22. In such a manner, the fluids can be very effectively stirred by a combination of the great passage of fluids through the openings 22*b* with the very fine vibration of the stirrer 26 in the vertical direction.

Since the openings 22*b* are out of phase in the circumferential direction for each stirring vane, the fluids will not be prevented from short-circuiting in the axial direction within the duct 10.

In accordance with the first embodiment, it will be apparent that a very efficient stir may be made by very fine vibration from the vibrator in addition to the division and joint of the fluids by the same stirring vanes as in the prior art stationary type stirring systems.

Figure 2:
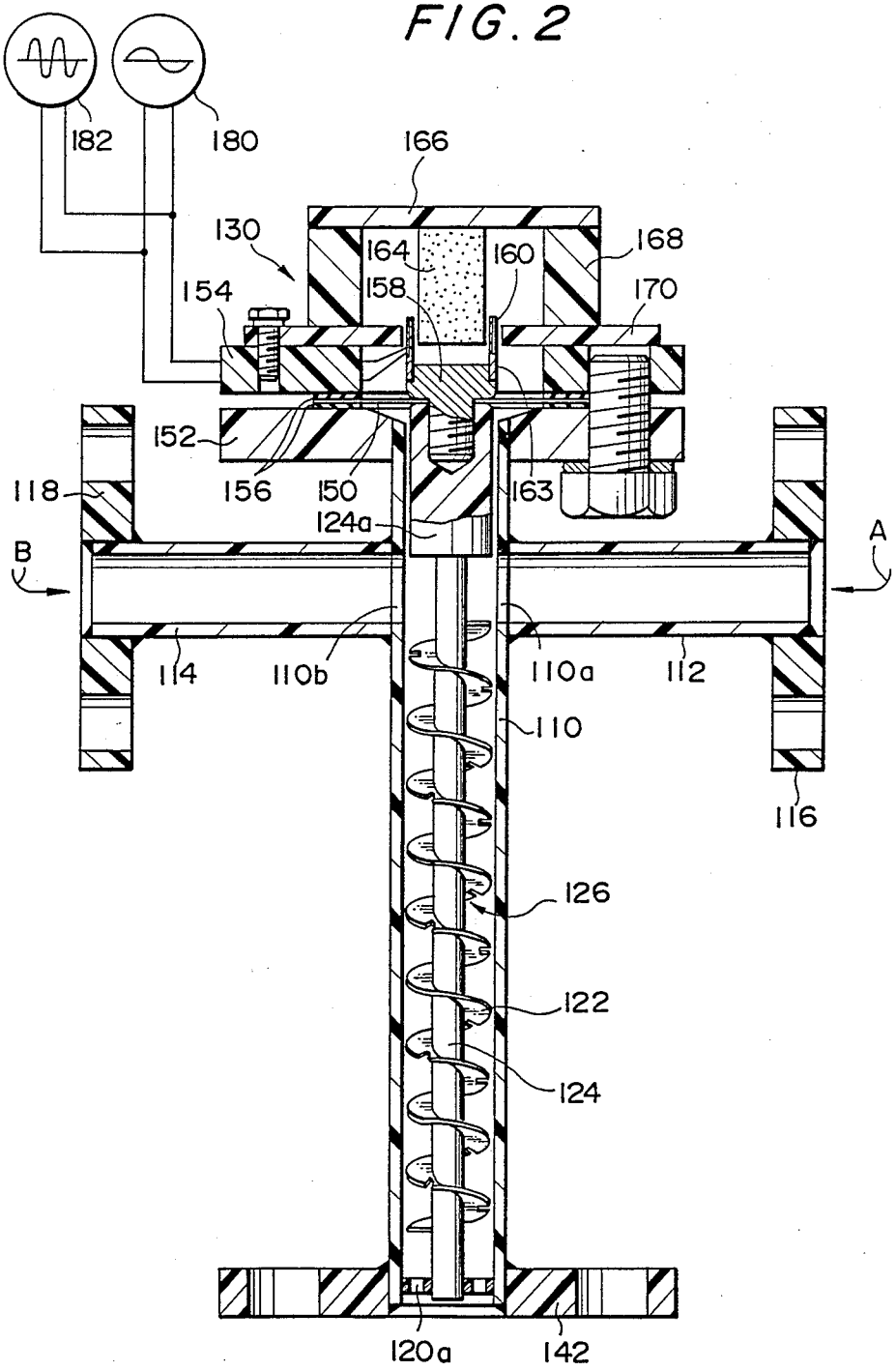
FIG. 2 is a schematic cross-section of the second preferred embodiment of a mixer constructed according to the present invention.

Referring now to FIG. 2, there is shown the second embodiment of a mixer according to the present invention, in which the stirring vanes are replaced by a spiral type stirring vane 122 and the vibrator is replaced by an electromagnetically driven vibrator 130.

Figure 3:
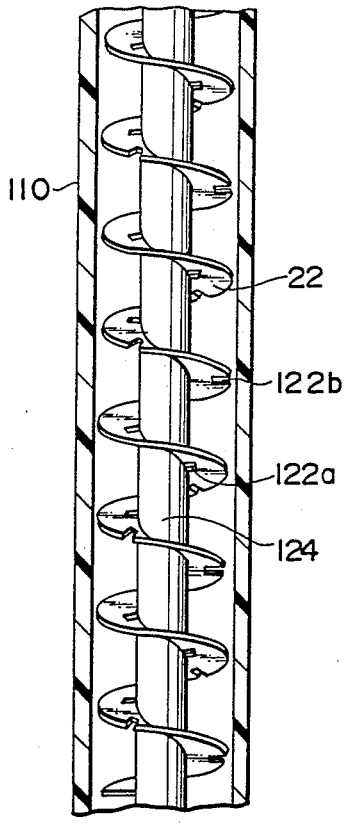
FIG. 3 is a fragmentary cross-sectional view of a portion of the stirring member shown in FIG. 2.

The second embodiment of the present invention is characterized by that the stirring vane 122 in the stirrer 126 is of a spiral screw configuration. As shown in FIG. 3, the spiral stirring vane 122 includes openings 122*a* and 122*b* which are formed therein with any suitable spacings at the outer and inner edges adjacent to the outer periphery of the stirrer shaft 124 and the inner periphery of the duct 110, respectively. It is preferred that the outer openings 122*b* are arranged to be circumferentially out of phase relative to one another with a predetermined angle, for example, 60 degrees. Thus, the fluids can be prevented from axially short-circuiting within the duct 110. The duct 110 may be fluid-tightly connected with a further pipe through a flange 142 on the bottom end of the duct 110.

In order to actually drive the stirrer 126, the second embodiment provides a source of vibration 130 at one end of the duct 110. The source of vibration 130 is electromagnetically driven.

The source of vibration 130 includes a diaphragm 150 for transmitting the vibration to the stirrer 126. The diaphragm 150 is made of a sheet metal and has its outer periphery which is rigidly sandwiched between a flange 152 sealingly mounted on the duct 110 and a retainer ring 154. Of course, the diaphragm 150 is in contact with the flanges 152 and the retainer ring 154 through packings 156 to prevent leakage of fluids.

The inner periphery of the diaphragm 150 is firmly fastened to the outer end of the slider 124*a* by means of a stator 158 which is screw-threaded into a central threaded opening on the outer end of the slider 124*a*.

The diaphragm 150 can not only finely vibrate the stirrer 126 in the axial direction under the flexibility of the diaphragm 150 itself, but also hold the stirrer 126 substantially in place due to the fact that the diaphragm 150 is rigidly mounted on the flange 152. A movable coil 160 forming a source of vibration is rigidly mounted on the stator 158 through an insulation support frame 162. The movable coil 160 is adapted to receive drive current from an external drive circuit which will be described hereinafter. It is preferred that the drive current is supplied to the coil 160 through a flexible printed circuit board on the surface of the stator 158 or diaphragm 150, for example. Thus, the movable coil 160 can receive the desired drive current without degrading the flexibility of the diaphragm 150.

On the other hand, a core 164 is disposed opposed to the movable coil 160 and rigidly mounted on the retaining ring 154 through a disc yoke 166, a ring magnet 168 and a ring yoke 170. These yokes 164 and 170 are made of a magnetic material. The ring magnet 168 is magnetized in its axial direction. A magnetic gap is provided between the inner periphery of the ring yoke 170 and the outer periphery of the right-hand end of the core 164. The movable coil 160 is disposed within this magnetic gap. When the movable coil 160 is supplied with a composite alternating current, therefore, it will be subjected to a composite axial vibration. As a result, the stirrer 126 will finely be vibrated within the duct 110 in the axial direction.

In the second embodiment, said composite alternating current is supplied to the movable coil 160 from two external sources of alternating current 180 and 182.

The sources of alternating current 180 and 182 define a low-frequency source and a high-frequency source, respectively. These sources have frequencies different from each other and selected, for example, from the conventional range of commercial frequency from 50 Hz to 1 KHz.

In such a manner, the stirrer 126 having the spiral screw-shaped stirring vane 122 can finely be vibrated in a complex vibration mode by the excitation of the composite alternating current from the sources of alternating current 180 and 182. Thus, the stirring action can more efficiently be accomplished by the mixer.

In the second embodiment, the stirrer 126 is subjected to a composite vibrating action consisting of a larger axial motion from the low-frequency source of alternating current 180 and a smaller axial motion from the high-frequency source of alternating current 182. Thus, a uniform stirring can be accomplished by the mixer.

In the second embodiment, thus, the stirrer 126 or stirring vane 122 can finely be vibrated within the duct 110 in the composite axial or circumferential mode by supplying the composite alternating current to the movable coil 160 of the vibration source 130. As a result, the fluids A and B passing through the duct 110 will be subjected not only to the static stirring action due to the stirring vanes, but also to the fine vibration due to the same stirring vanes so that the fluids can more efficiently be stirred and mixed together.

Although the second embodiment has been described as to the use of the electromagnetically driven source of vibration utilizing the movable coil, a stationary coil can be used instead of the movable coil. In such a case, a permanent magnet will be disposed as a movable part.

The vibrator 130 may be replaced such a motor-cam mechanisum as used in the first embodiment.

Figure 5:
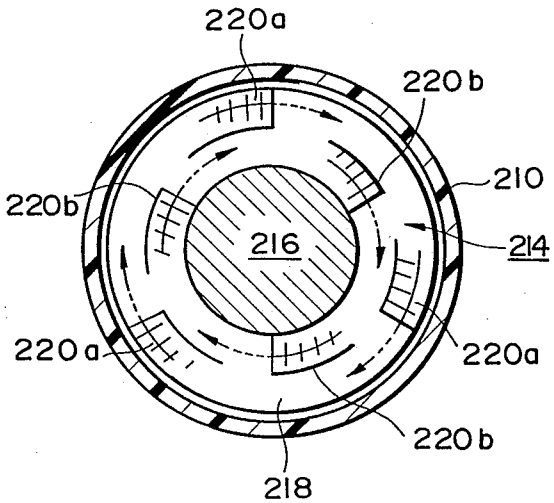
FIG. 5 illustrates the mixing action in the mixer of FIG. 4.
Figure 4:
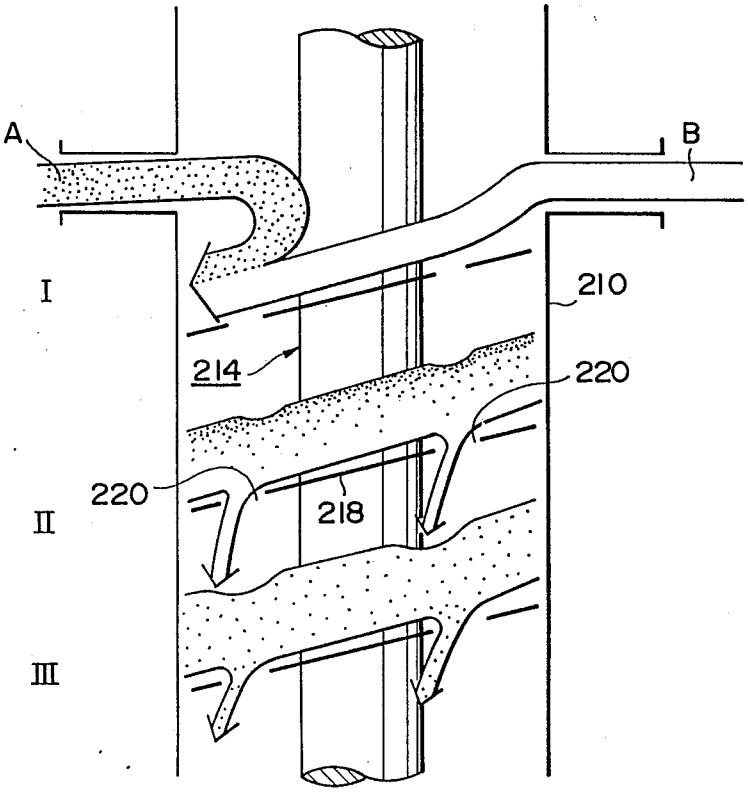
FIG. 4 is a cross-sectional view of the third preferred embodiment of a mixer constructed according to the present invention, the mixer being incorporated into a powder mixing system.

FIGS. 4 and 5 shows the third preferred embodiment of the present invention which comprises a cylindrical and vertically extending duct 210 including two inlet port **210*a* and 210*b* formed therein at the top. Different kinds fluids having high viscosity or powders A and B are introduce the housing 210 through the respective inlet ports 210*a* and 210*b***.

The cylindrical housing 210 form a duct and a mixing element 214 forming a stirrer are mainly shown in FIG. 4, but means for vibrating the housing 210 and mixing element 214 is not illustrated for simplicity.

The fluids or powders A and B may be pumped into the housing 210 through the respective inlet ports **210*a* and 210*b* or drawn into the housing 210 under the action negative pressure source at the downstream side of the housing 210**.

An end seal wall 212 is sealingly fitted in the top of the housing 210. In the illustrated embodiment, the end seal wall 212 is further fastened to the mixing element 214 at one end so that the latter can rigidly be supported within the housing 210.

The mixing element 214 comprises an element shaft 216 rigidly connected at one end with said end seal wall 212 and a spiral blade 218 provided about the outer periphery of the element shaft 216. The fluids or powders introduced into the housing 210 in the aforementioned manner are moved downwardly along the spiral blade 218.

In the third embodiment, therefore, main passage of the fluids or powders to be mixed is defined into a spiral passage by the spiral blade 218. Even if the length of the housing 210 is relatively small, the fluids or powders A and B can be moved in the sufficiently long passage defined by the spiral blade 218. During this movement, the fluids or powders can sufficiently be mixed with each other in cooperation with the vibrating action.

The third embodiment of the present invention is characterized by the fact that the spiral blade 218 includes openings 220 formed therein and spaced away from one another along the length thereof. Each spiral passage stage in the spiral blade 218 includes at least one of such openings 220. Thus, each adjacent spiral passage stages are partially connected with each other through at least one opening 220.

The material of the spiral blade 218 is partially turned down from one spiral passage stage to the next spiral passage stage at each of the openings 220. Therefore, part of the fluids or powders can be inducted into the next spiral passage stage through each of the openings 220. Even if the openings 220 are arranged in phase on each adjacent spiral passage stages, the fluids or powders fallen into the next spiral passage stage can positively be inducted into the next spiral passage stage as shown by arrow in FIG. 4. Thus, the fluids or powders can be prevented from moving along the axis of the housing 210 without obstruction.

The size of the openings 220 is determined depending on the viscosity and other factors of the fluids or powders to be mixed and also depending on the rate of the branch flow moved from the main flow into each of the adjacent spiral passage stages.

The fluids or powders having high viscosities introduced into the first spiral passage stage move with a low degree of mixture, that is, under such a state that the fluids or powders are substantially separated from each other.

In the second spiral passage stage, the branch flows of the fluids or powders begin to be mixed gradually with the main flow moving along the spiral blade 218.

However, the speed of the mixture is slow since the fluids or powders having high viscosities produce less turbulent flow in comparison with fluids or powders having lower viscosities.

Figure 6:
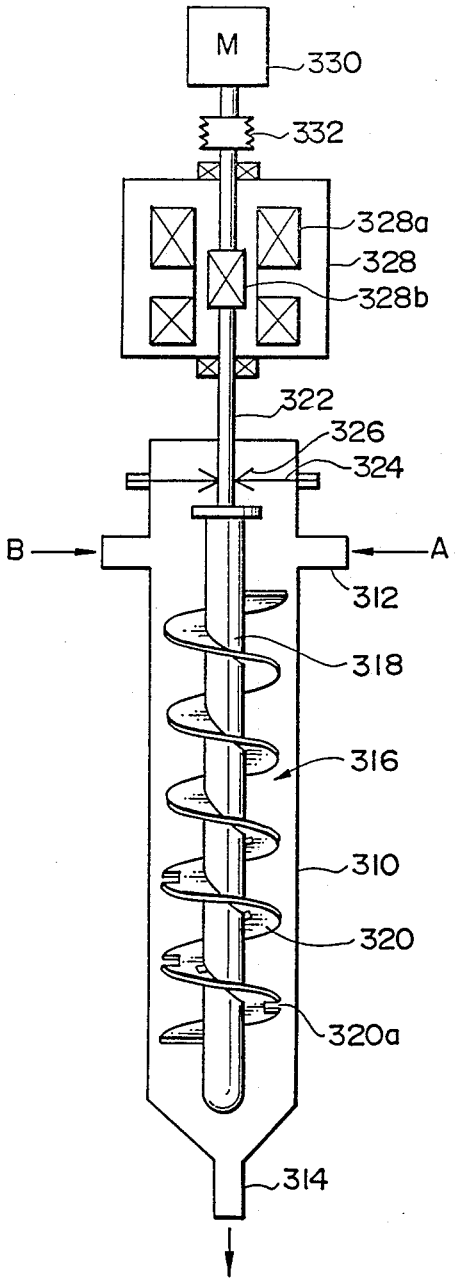
FIG. 6 is a schematic cross-section of the fourth preferred embodiment of a mixer constructed according to the present invention, the mixer having a stirrer shaft which is rotatably driven.

The present embodiment is characterized by that the openings 220 formed in the spiral blade 218 communicate one spiral passage stage with another adjacent spiral passage stage. As a result, there will be created branch flows between each adjacent spiral passage stages through the openings 220, as shown in FIG. 6.

As seen from FIG. 4, each of the branch flows between the second and third spiral passage stages is occupied substantially by one of the fluids or powders B. The fluid or powder B is mixed mainly with the upper layer, that is, the layer of the other fluid or powder A in the third spiral passage stage. This shows that the mixing action between the branch flows and the main flow is very useful.

In such a manner, as the fluids or powders is being moved to the subsequent spiral passage stage, they can more efficiently be stirred and mixed with each other under the mixing action in the branch flows in addition to the vibrating action.

FIG. 5 shows the spiral blade 218 which includes inner and outer lines of openings 220 which extend along the length of the spiral blade 218.

As seen from FIG. 5, each stage of the spiral blade 218 has three openings **220*a* angularly spaced away from one another by an angle of 120 degrees along the outer periphery of the spiral blade 218 and three openings 220*b* similarly spaced away from one another by 120 degrees and also positioned out of phase relative to the corresponding opening 220*a*** through an angle of 60 degrees.

In the third embodiment, therefore, the outer and inner layers of the fluids or powders moving in the main passage will be fallen into the next spiral passage stage at different locations to form branch flows. This further improves the efficiency of the stirring.

Although not illustrated, the third and fourth embodiments of the present invention each has vibrating means which is particularly effective to eliminate the jamming of the powder within the housing, as described hereinbefore.

As be well-known, the powder materials tends to create a local jamming which can be promoted under pressure. Such a jamming must promptly be eliminated by any suitable mechanical means. Otherwise, the mixer will easily be inoperative. Moreover, the powders to be mixed themselves can be damaged.

As in the embodiment of FIG. 1, the present embodiment intends to overcome such problems by vibratably holding the housing against the base through diaphragm. The mixing element is rigidly connected at the opposite ends with the housing to be vibratable together with the housing.

Experiments showed that the vibrating action could create substantially no jamming in the moving powders and very remarkably promote the mixture of two different powders.

In the third embodiment, vibrating means for vibrating the mixing element may be of any suitable vibrator mechanism as described hereinbefore.

As will be apparent from the foregoing, the present invention provides a mixer comprising a housing, a mixing element and spiral blade means forming a sufficiently long main passage and having openings communicating one spiral passage stage with another adjacent spiral passage stage in the main passage. Thus, part of the main passage can be divided into a number of branch flows moving between each adjacent spiral passage stages through the openings. These branch flows are stirred and mixed by the main flow to improve the stirring and mixing actions against the fluids or powders to be mixed.

Referring not to FIG. 6, there is shown the fourth embodiment of a mixer according to the present invention, which comprises a duct 310 in the form of a pipe. The duct 310 comprises two inlet ports 312 adjacent to the top thereof and an outlet port 314 at the bottom of the duct 310. The duct 310 also comprises a stirring member 316 which is coaxially disposed within the duct 310. The stirring member 316 includes a shaft 318 and a spiral vane 320, the top end of the shaft 318 being connected with a connecting shaft 322.

A diaphragm 324 is provided to surround the outer peripheral face of the connecting shaft 322 so that fluids can be prevented from moving spattering upwardly beyond the top end of shaft 318. The inner periphery of the diaphragm 324 includes a sealing spring 326 for joining the diaphragm 324 with the connecting shaft 322.

The connecting shaft 322 is connected with an electric motor 330 through an electromagnetically driven source of vibration 28. An extendable connecting member 332 is disposed between the vibration source 328 and the electric motor 330. The vibration source 328 includes a stationary coil **328*a* disposed within the vibration source casing and a movable coil 328*b* rididly mounted on the connecting shaft 322. Thus, the connecting shaft 322** can be vibrated in the vertical direction.

A fluid to be stirred may be supplied into the duct 310 through one of the inlet ports 312 In the illustrated embodiment, two different fluids can be inducted into the duct 310 through the two inlet ports 312 so that they can be stirred and mixed together within the duct 310. The fluids from the inlet ports 312 move downwardly while contacting the spiral vane 320 and then discharged outwardly from the duct 310 through the outlet port 314 as a stirred mixture.

The spiral vane 320 includes openings **320*a* formed therein with suitable spacings. A portion of the fluids passes through these openings 320*a* to improve the mixing action. It is not necessarilly required that the stirring member 316 includes the spiral vane 320 extending along the length thereof. A portion of the spiral vane 320** may include a plurality of radially extending rod-like elements.

In such an arrangement, when the vibration source 318 is energized, the movable coil **328*b* rididly mounted on the connecting shaft 322 is vertically vibrated under the action of a magnetic field which is created by the stationary coil 328*a***.

The connecting shaft 322 on which the movable coil **328*b* is mounted is thus vibrated vertically to vibrate the stirring member 316 in the same direction. The vertical vibration of the stirring member 316 promotes the stirring of the fluids at the surface of the spiral vane 320**.

The connecting shaft 322 is further rotated by the electric motor 330. The fluids are thus propelled downwardly under the action of the rotating spiral vane 320. Even if fluids having increased viscosity or powdery fluids having less fluidity are to be stirred and mixed together, the propelling force created by the rotation of the spiral vane 320 assures the downward movement of such fluids to efficiently prevent any clogging within the duct 310. In addition, the diaphragm 322 and associated parts will not be damaged by the fluids moving upwardly toward the inlet ports 312.

By regulating the revolution of the electric motor 330, the aforementioned propelling force may be optimized depending on the type of fluids to be stirred and/or mixed together, resulting in improvement of the stirring action. Since the spiral vane 320 is vertically vibrated and also rotated, new successive portions of the fluids smoothly move along the surface of the spiral vane 320 to further improve the stirring action.

The electric motor 330 may be fixedly connected with the top end of the connecting shaft 322 since the extendable connecting member is utilized therein.

The spiral vane 320 may be provided with openings 320*a* directed as shown in FIG. 2. Such a spiral vane is particularly preferred when two different fluids are to be moved under gravity.

Although the vibration source 328 is of an electromagnetical type, it is not limited to such a type and may be of any one of various other types such as mechanical type, ultrasonic type and pneumatic type. In addition, the electric motor 330 may be replaced by any one of various other type motors such as pneumatic motor, hydraulic motor and the like.

Figure 7:
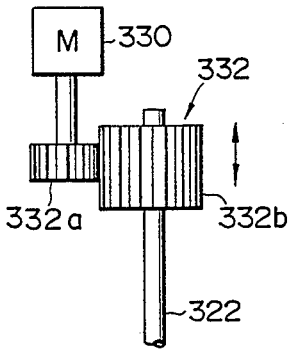
FIGS. 7 through 10 illustrate the arrangements of the vibrator and rotationally driving means shown in the fourth embodiment of the present invention.

FIGS. 7 through 10 illustrate various other configurations of vibration and rotation sources. Referring first to FIG. 7, there is shown an arrangement in which the connecting member 332 comprises a pair of gears 332*a* and 332*b*. In such an arrangement, the vertical motion of the connecting shaft 322 is accommodated by the sliding motion between the gears 332*a* and 332*b*. As a result, the electric motor 330 can be shut off the vertical motion of the connecting shaft 322.

Figure 8:
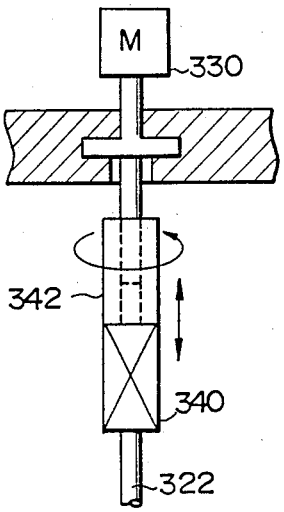

FIG. 8 shows an ultrasonic type source of vibration 340 which is connected between a connecting member 342 and the connecting shaft 322. The connecting member 342 is slidably connected with the electric motor 330 against rotation, for example, by the use of key-groove type or gear type anti-rotation means. Therefore, the output shaft of the electric motor 330 will not be moved vertically even when the connecting member 342 is vertically vibrated. Accordingly, the rotation of the electric motor 330 is transmitted to the connecting shaft 322, but the vertical vibration of the connecting shaft 22 will not be transmitted to the electric motor 330.

Figure 9:
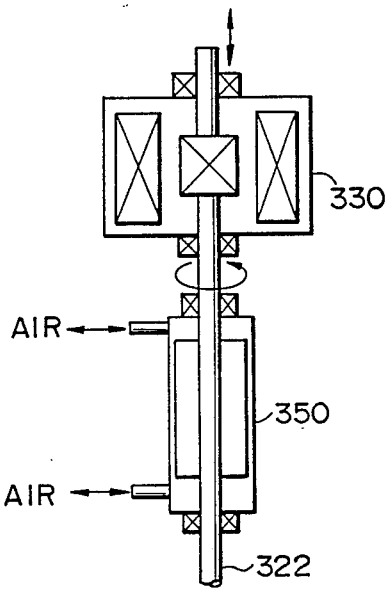

Referring next to FIG. 9, there is shown an pneumatic cylinder type vibrator 350. Thus, the electric motor 330 can accommodate the vertical motion of the vibrator 350 since the output shaft of the electric motor 350 itself can move vertically.

Figure 10:
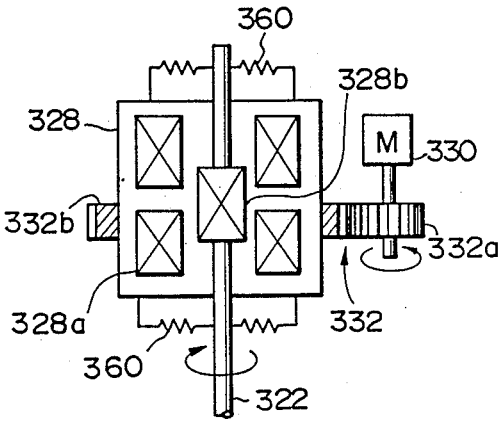

In such an arrangement as shown in FIG. 10, the entire body of a vibration source 328 is vertically vibrated. The rotation of the electric motor 330 is transmitted to the vibration source 328 through a connecting member 332 consisting of gears 332*a* and 332*b*. Therefore, a connecting shaft 322 will be subjected to both the vertical vibration and rotation of the vibrator 328 itself. Diaphragms 360 are provided to absorb the vertical motion of the connecting shaft 322. It is preferred that the rotation of the vibrator 328 is transmitted to the connecting shaft 322 through a key-groove connection or the like.

Figure 11:
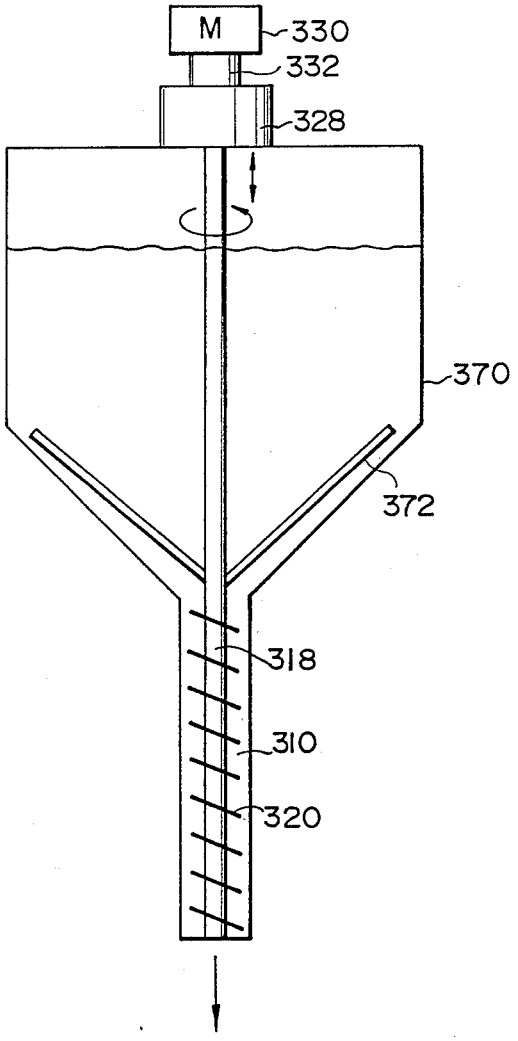
FIG. 11 is a schematic cross-section of the fifth preferred embodiment of a mixer constructed according to the present invention.

FIG. 11 shows the fifth embodiment of a mixer according to the present invention, in which a duct 310 includes a storage tank 370 mounted on the top thereof. The storage tank 370 contains a fluid which is to be stirred while moving the duct 310. The duct 310 includes a stirring member 316 having a shaft 318 which is operatively connected with a vibrator 328 as in the previous embodiments. The vibrator 328 is connected with an electric motor 330 which serves as a source of rotation. Thus, the stirring member 316 can be vibrated vertically and also rotated to stir and move the fluid from the storage tank 370. In this embodiment, the shaft 318 includes a scraping vane 372 which is adapted to break any bridge created in the fluid from the storage tank 370 to provide a smooth movement of the fluid within the duct 310 together with an improved stirring action.

I claim:

1. A mixer comprising duct means for receiving a plurality of different fluids, stirrer means disposed within said duct means, said stirrer means including a stirrer shaft and stirring vane means rigidly mounted on said stirrer shaft to form a plurality of spaces along the length of said stirrer shaft, said stirrer vane means being adapted to stir and mix the fluids inducted in to said duct means, said stirrer vane means including openings means through which the fluids can move, said stirring vane means further comprising a spiral screw-shaped vane having openings which are formed in and spaced away from one another along at least one of the inner and outer marginal edges of said spiral vane at circumferential different positions, and vibrator means for vibrating said stirrer means within said duct means, whereby the fluids can be stirred and mixed together while moving from one space in the stirring vane means to another through the corresponding opening means during vibration of said stirrer means.

2. A mixer as defined in claim 1 wherein said vibrator means is in the form of an electromagnetically driven vibrator.

3. A mixer as defined in claim 2 wherein said vibrator means includes a vibrator having two different frequencies to provide a combined vibration.

4. A mixer as defined in claim 1 wherein said vibrator means includes a motor-cam mechanism.

* * * * *